US005465967A

United States Patent [19]

Boeckenhaupt

[11] Patent Number: 5,465,967

[45] Date of Patent: Nov. 14, 1995

[54] UNIVERSAL GRIP WITH ADJUSTABLE BACKWEIGHTING CAPABILITY

[76] Inventor: Herbert Boeckenhaupt, 116-A Whiskey Creek Rd., Hollywood, Md. 20636-9530

[21] Appl. No.: 331,466

[22] Filed: Oct. 31, 1994

[51] Int. Cl.[6] ..... A63B 53/14

[52] U.S. Cl. ..... 273/162 R; 273/162 F; 273/81 A

[58] Field of Search ..... 273/81 R, 81 A, 273/67 R, 67 DB, 73 J, 75, 162 R, 162 F, 32 B, 32 R

[56] References Cited

U.S. PATENT DOCUMENTS

| | | | |
|---|---|---|---|
| 1,210,182 | 12/1916 | Lynch . | |
| 1,669,836 | 5/1928 | Neuberth | 273/162 F |
| 2,051,083 | 8/1936 | Hart . | |
| 2,739,331 | 3/1956 | Goodman | 273/162 F |
| 3,075,768 | 1/1963 | Karns . | |
| 3,342,489 | 9/1967 | Waldo | 273/81 A |
| 3,606,327 | 9/1971 | Gorman | 273/81 A |
| 4,461,479 | 7/1984 | Mitchell . | |
| 4,600,195 | 7/1986 | Hunter . | |
| 4,690,407 | 9/1987 | Reisner . | |
| 4,988,102 | 1/1991 | Reisner . | |
| 5,152,527 | 10/1992 | Mather et al. . | |
| 5,244,209 | 9/1993 | Benzel . | |
| 5,244,210 | 9/1993 | Au | 273/171 |

FOREIGN PATENT DOCUMENTS

| | | | |
|---|---|---|---|
| 20180 | of 1903 | United Kingdom | 273/81 A |
| 194823 | 3/1923 | United Kingdom . | |

*Primary Examiner*—Sebastiano Passaniti
*Attorney, Agent, or Firm*—Christopher W. Brody; Lowe, Price, LeBlanc & Becker

[57] ABSTRACT

A grip and backweighting assembly for an athletic implement includes an insert which attaches to the distal end of the athletic implement grip. A series of weights and, optionally, dampers can be mounted to a distal end of the insert for adjusting the backweighting of the athletic implement. In this manner, backweighting can be custom tailored to a user of the athletic implement by easy removal or attachment of the weights as well as ease of removal and/or attachment of the weight-containing insert to the athletic implement. The insert also includes features to facilitate securing the insert to the athletic implement handle.

17 Claims, 2 Drawing Sheets

UNIVERSAL GRIP WITH ADJUSTABLE BACKWEIGHTING CAPABILITY

FIELD OF THE INVENTION

The present invention relates to athletic implements, such as golf clubs, that have improved weight distribution wherein additional and adjustable weighting is provided in the handle or shaft.

BACKGROUND OF THE INVENTION

Numerous athletic games require the use and swinging of an athletic implement that has a head portion and a shaft. Examples of such athletic implements include golf clubs, tennis rackets, polo sticks and baseball bats.

One of the problems that has long existed in these athletic endeavors is the accuracy of the control of the athletic implement when it is being swung by the player. For example, in the game of golf, loss of control of the golf club occurs during the back swing when the head portion deviates from the plane in which the club should remain. As a result, there is a disadvantageous loss of control of the club which prevents golfers from experiencing optimum results in striking the golf ball during the forward portion of the swing.

Golf clubs have been designed which add weight to the head end of the club, but there are deficiencies and attempts to overcome such deficiencies with redistributing the weight along the device have been proposed in the prior art. Thus, attempts have been made to add weight adjacent to the hand held portion of the device to improve control of and the resulting accuracy of the movement of the athletic device. When this is done, it is possible to control the implement more precisely and maintain it in the desired plane of movement when the implement is swung in the forward direction to make contact with an object.

Of even greater significance with golf clubs and the problem of weight distribution is the advent and use of new high-technology golf shafts made of graphite, graphite-boron, or metal-graphite-boron composites. These new golf shafts, which are manufactured with precise predictability with respect to flexibility and flex point location along the shaft, have also added a new consideration called torque, which is the twisting of the shaft about its longitudinal axis, a dynamic factor which heretofore did not exist with all-metal golf shafts. This torquing action has created a wide variety of choices for golfers of all skill levels in selecting the appropriate club shaft for improvement of their game, and has complicated the issue of club weight and balance. Additionally, because of the lighter weight of the graphite or graphite-boron composite shaft, the club head may be made heavier while maintaining the same overall club weight, a distinct advantage in the area of control and distance.

The current theories of golf ball distance and control predicates itself on lightness of the shaft and club head weight and mass along with the increased speed of the head at time of impact with the ball. The mass, weight, speed equation as relates to propelling the golf ball is the primary basis for design of modern day golf clubs using high technology composite shaft construction techniques. However, as the weight of the club head is increased, club head speed at point of contact is reduced. It is therefore necessary to rebalance the club by backweighting.

U.S. Pat. No. 2,051,083 to Hart discloses what is described as a golf shaft balancer which in effect is a weighted insert adapted to pass into a hollow shaft and be longitudinally positionable as well as rotatable within the shaft to give the shaft a desired feel. The balancer is described as being particularly useful in putters which in fact do not have an extended amount of flex and virtually no torque when used.

U.S. Pat. No. 1,210,182 to Lynch also discloses a solid club in which a lead weight is supported at one end and enclosed by a ferrule or cap affixed to the end of the solid shaft club.

U.S. Pat. No. 3,075,768 to Karns provides a compartment in one end of a golf shaft in which is disposed a separate container or sack containing weighted particulate material. Alternatively, a plug is disposed within the shaft and frictionally or adhesively retained in place on top of which is positioned the particulate or shot material which is to be retained in place by a plug or adhesive, followed by affixing the actual grip to the club shaft.

U.S. Pat. No. 4,461,479 to Mitchell offers an insert which consists of a fixed unit of weight with a vibration deadening sleeve which inserts into the shaft prior to affixing the grip to the club shaft, a technique not too dissimilar than Karns above.

U.S. Pat. No. 4,600,195 to Hunter suggests cutting off the end of the grip to expose the hollow shaft and adding an adapter which glues into the shaft. By adding an unlimited number of weights to the adapter, which extends externally behind the gripping portion of the club, improvements are realized.

U.S. Pat. No. 4,690,407 to Reisner goes even further in molding the golf grip around a segmented section of fixed weight and this assembly then is the final grip which is affixed to the free end of the club. U.S. Patent No. 4,988,102 also to Reisner modifies the design of the segmented weight in the '407 Reisner patent to improve attachment characteristics when affixed to the golf shaft.

Great Britain Patent No. 194,823 to Stirling discloses improvements in golf clubs and, more particularly, shows adjustable weights provided in an axial bore in the handle or shaft of the club.

While the above documents disclose attempts to balance an athletic implement shaft of the type that is swung, particularly a golf club, none of the techniques shown or embodiments disclosed have solved the real problem of the backweighting technique whereby the weights are simultaneously physically functional, not disconcerting to the golfer, readily interchangeable but still within the rules of the United States Golf Association pertaining to the golf grip, and can be varied on a club-by-club basis through dynamic performance testing by the golfer and can be done in a quick, efficient manner without a golf club technician's assistance.

In the cited documents, weights of fixed value are applied by use of a mechanical or adhesive means prior to affixing the grip to the club, or by a destructive means of cutting off the end of the grip in order to alter the balance point. The technique of adding the weights prior to affixing the grip are based on a calculation of presumed best weight rather than through dynamic performance testing by the actual user of the golf club for optimal results in accuracy and distance on a club-by-club, player-by-player basis, as is with the instant invention.

Hart's insert requires that it be glued or mechanically held in place at some point along the golf club shaft. This solution would have been functional with metal shafts but is not compatible with graphite-composite golf shafts in that a stress point is created altering the entire design characteristics and creating a point of potential breakage of the shaft when it strikes the ball. Modern club heads are purposely manufactured with a twenty degree reaming of the inside of the ferrule rather than a parallel snug fit which causes a stress point and point of breakage. Graphite shafts, when scored, will break in a manner similar to window glass when scored with steel and subjected to pressure.

Lynch, Karns, and Mitchell all require affixing the grip after the weight is added. Reisner has the fixed unit of weight as an integral part of the grip on a one-weight-one-grip-fits-all basis. Hunter advocates cutting off the ends of all golf grips, adding an adapter section by gluing in place, then adding weight after weight to achieve the desired end result.

The flaws in Lynch, Karns and Mitchell are obvious in that all weighting is of a fixed amount and the grip is installed after the weight is added. Testing of the club must wait from 4- to 24-hours and if not correct or best suited for the golfer, the grip must be removed, which is a destructive process, a new weight inserted, a new grip installed, and a new waiting period starts again. This is not a desirable situation when a golfer is on the practice range with a tee time in one hour.

Reisner seeks a compromise solution to the problem, but declares that one grip with the same weight will do the job for all clubs. It is highly unlikely that a fixed unit of weight would produce the same results on such a broad range of players as a hard-hitting low-handicapper compared with a slow-swinging lady-senior. Perhaps a mid-range golfer could use the same weights, but the problem of the same weight for each club not being the ideal solution remains unsolved in the Reisner patent. Additionally, there are a considerable number of different types of golf grips available to the golfer, who selects them on size and feel. The Reisner grips would have to be molded into every possible type of grip for both men and ladies club in two shaft diameters of 0.580" or 0.600" and, if a choice of weights were made available, the sheer inventory of golf grips required by the industry would make the use of the Reisner technique a logistical and inventory nightmare from manufacturer to retailer or custom clubmaker. Additionally, the variety of club head weights and shaft combinations dictate that a fixed-weight concept is not the solution to optimization of golf club performance.

Hunter carries the concept to extremes and with the current technology of heavier club heads on lighter shafts, the length of weight to be added behind the grip could exceed the length of the grip itself, even to the point of hitting the golfer's body when the club is swung back. Hunter's arrangement of back weights creates a problem rather than solves one with today's golf club composite materials applications. The Hunter design is disconcerting to the golfer, mechanically increasingly unstable with a great number of weights, and adds weight in a manner that is much too far away from the butt end of the club to be effective. A player would be better off with longer shafts, longer grips and holding the club lower down the shaft than by using the Hunter extensions. It is not incidental that manufacturers of graphite composite shafts recommend cutting the butt end of the shaft ½" to 1" longer than standard fit for the golfer to help offset the imbalance caused by the heavier head and lighter shaft and allow for greater club head speed at impact.

The device of the Stirling patent is also unsuitable for modern day golf club design since the device is directly attached to the handle and the weights are in direct contact with the handle. This design makes it difficult to adapt to different clubs and is conducive to imparting vibration to a user via the weights.

As such, a need has developed to provide an improved golf grip with adjustable back weighting capability that overcomes the disadvantages of the prior art as discussed above. Responsive to this need, the present invention provides such a grip which enables a user to fine tune a given athletic implement for the user's ability.

SUMMARY OF THE INVENTION

It is a first object of the present invention to provide a grip having backweighting capability for an athletic implement that is capable of being altered on a club-by-club basis.

Another object of the present invention is to provide a grip which does not require gluing or permanent installation prior to its testing.

Another object of the present invention is to provide a grip for an athletic implement which has non-destructive features and permits the adjusting of backweighting for the implement depending on a user's capabilities.

Other objects and advantages of the present invention will become apparent as a description thereof proceeds.

In satisfaction of the foregoing objects and advantages, the present invention is an improvement in athletic implements comprising a hollow shaft with a club head on one end and a gripping portion on the opposite end. According to the invention, the gripping portion includes an adjustable backweighting assembly which further comprises a plurality of weights removably mounted on an insert. A grip is provided and sized to surround the gripping portion of the athletic implement, the grip having a through opening in an end thereof. Further, means for removably attaching the insert-mounted weights to the grip is provided such that the weights and a portion of the insert extend within the hollow shaft gripping portion for adjusting backweighting of the athletic implement.

Preferably, the means for removably attaching further comprises an internally threaded portion on the proximal end of the grip and an externally threaded portion on the proximal end of the insert. These threaded portions are sized to engage each other such that the insert can be threadably attached to the grip proximal end.

More preferably, the insert also includes dampening washers arranged between the weights, the washers sized to press against the interior of the hollow shaft for vibration dampening.

In another embodiment of the invention, the insert also includes means for rotation thereof on its proximal end. The means for rotation can comprise a pair of recesses in the insert proximal end, each recess sized to receive a rotating tool for insert rotation. In another aspect of the invention, an end cap is provided which fits over the proximal end of the insert to complete the grip of the athletic implement. The end cap can also have bores in an end thereof which align with the recesses in the proximal end of the insert to facilitate its rotation. Preferably, the athletic implement is a golf club.

DETAILED DESCRIPTION OF THE PREFERRED EMBODIMENTS

Figure 1:
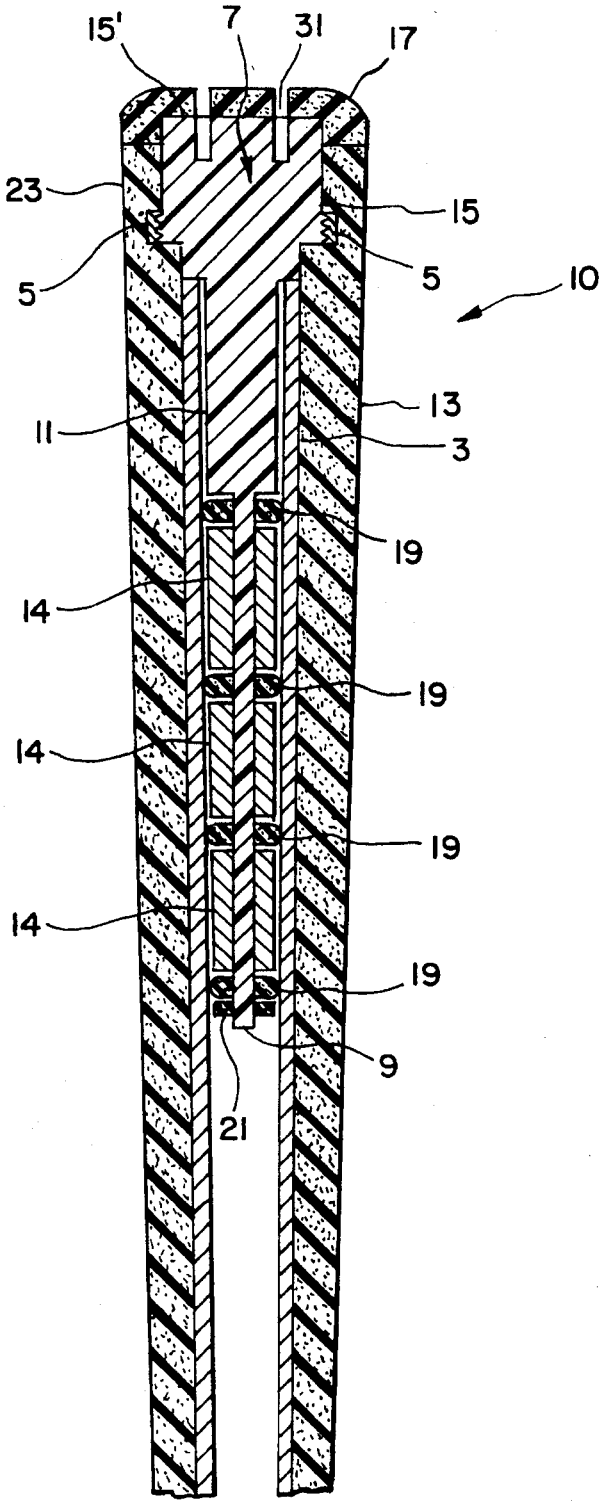
FIG. 1 is a cross-section of the grip and adjustable backweighting assembly of the invention mounted on the end of golf club.

In accordance with the present invention there is provided an athletic implement such as golf club, tennis racket, polo stick, baseball bat or other device having a head portion at one end and an elongated hollow shaft or rod means extending to the opposite end which is adapted to be held. An additional weight is incorporated at the opposite held end for redistributing the weight along the athletic implement. The weight is retained in place without movement, noise or shifting of position, and the weight used does not shatter or destruct when the implement is used.

The athletic implements with which the present invention is particularly useful are those in which the balance point is located intermediate the opposite ends thereof and is normally of the type adapted to be swung to strike an object such as a ball to impart movement thereto, and in which it is important to control the motion and path of the implement in order to properly strike the object and impart desired movement thereto.

Such athletic implements may comprise a golf club, tennis racket, polo stick, baseball bat or other athletic device having a head portion at one end and rod or shaft means at the opposite end for holding the athletic implement. The athletic implement has a balance point at a location intermediate the ends thereof.

If a weight is mounted to the implement between the location of the balance point and the distal end of the rod or shaft, i.e., the end opposite the head portion, the added weight moves the balance point closer to the distal end. The weight is preferably mounted to the implement in the area where the player holds the implement.

One of the athletic implements with which this invention can be used is golf clubs. A golf club has a head with a predetermined weight, a shaft having one end secured to the head and an opposite outer end. A grip is secured to the shaft adjacent to the outer end of the shaft.

The weight means preferably is secured to the golf club within about one-third of the length of the club from the outer, gripping end of the club. The weight means has a second weight, whereby the total weight of the club within one-third of the length of the club from the outer end, which is within about fourteen inches of the outer end, is increased and may be done so with varying weights in an efficient manner.

By adding the weight means to the golf club, the balance point or center of gravity of the club is moved from its original location to a point that is closer to the outer end of the golf club, and is thereby closer to the area where a player grips the golf club, and is directly under the hand closest to the butt end of the club shaft. It appears desirable to add the weight means to shift the center of gravity or balance point from its original location which is closer to the head end towards a point which is about midway or just above the length of the entire club. This enables the person to exert greater accuracy and control in swinging the club, thereby improving the golf game. This also enables the person to strike the ball with increased club head speed, thereby causing the ball to travel a greater distance.

A method in accordance with the present invention of improving the weight distribution of an athletic implement such as a golf club to enable a player to more accurately control the movement of the club, comprises the steps of adding weight to the golf club between the location of the balance point of the unweighted club and the outer end of the shaft, and moving the balance point by means of the added weight from the first location closer to the head end to a point between the first location and the outer end of the shaft, typically about midway or higher between the ends of the club.

More specifically, in accordance with the present invention there is provided a weight means constructed of a solid material such as a lead alloys, copper or steel which may be inserted into the hand held end of a hollow shaft forming part of an athletic implement. The weight is constructed to prevent any movement thereof when inserted and to resist shattering, disassociation or disintegration which might result from physical and thermal shocks during use of the implement. The weight does not produce an unwholesome or unsatisfactory sound does not give rise to undesirable changes to the characteristics of the implement in terms of feel or sound, but does provide the desired improved control of the implement in use.

Thus, in accordance with the present invention the weight is adapted to be inserted into the end of the shaft of an athletic implement such as a golf club and is configured to preclude movement longitudinally on the shaft.

The golf club is equipped with a universal grip into which is molded a hexagonal nut-like device which resists rotation and has internal threads of a diameter slightly smaller than the average inside diameter of the thicker-walled graphite composite golf shafts, which is approximately 0.500" diameter. This nut-like device is receded into the butt end of the grip a distance sufficient to allow the screw-in device described below to penetrate for mechanical integrity and create a tight seal.

A second device consists of a long small diameter externally threaded rod with a larger diameter upper externally threaded section which is molded into an end cap of material similar to the golf grip. This upper threaded portion with end cap, when screwed into the nut-like internal member of the universal grip, provides a sound mechanical linkage. The outside of the end cap has two small indents into which is inserted the prongs of a standard golf shoe spike wrench as a means of installing or removing the internal member for adjustment of the weights affixed thereto.

Weights of varying amounts are added to the small diameter threaded rod as needed to achieve maximum distance and control of the golf ball when struck and held in place with a small nut to provide added mechanical stability. These weights have internal threads to allow them to be screwed up the small rod to a snug fit above and below preventing any noise or vibration which would normally accompany unthreaded weights on a smooth rod. The same tool used to install the end cap is used to tighten the weights and end nut along the rod.

The end cap is made of the same composite material as the grip and of the same diameter as the grip open end. It creates a natural looking and secure seal on the butt end of the grip. It is resistive to shock when dropped butt first into the golf bag, the normal manner of storing golf clubs.

The internal nut-like member along with the threaded rod insert may be made of nylon or similar rigid light weight material for strength and minimum weight affect overall. Both are readily adaptable for use with injection molding techniques employed in the manufacture of golf grips.

The universal grip may be installed on new clubs or retro-fitted onto older clubs, including those with metal shafts whose inside diameter is greater than those of graphite composite. When used with a metal shaft, the vibration dampening adapter should be added to provide a cushion between the weights and the inside of the steel shafts.

The universal grip with backweighting capability in this invention solves the problems associated with prior art in that it provides a method of backweighting, is mechanically sound, is not disconcerting to the golfer, has the capability to be changed on a club-by-club basis, can be altered quickly and efficiently after dynamic performance testing, is readily adjustable golfer-by-golfer, on a do-it-yourself basis, does not require gluing or permanent installation prior to testing, and is not destructive during the installation process. Moreover, should a club not require any backweighting the end cap device with the long narrow threaded rod portion removed may be installed without weights with no alteration to the balance or swing weight of the club.

While this invention is possible of embodiment in other, slightly modified forms, there is shown in the drawings and described hereinafter in detail, specific preferred embodiments of the invention, with the understanding that the present disclosure is to be considered as an exemplification of the principles of the invention and is not intended to limit or restrict the invention to the embodiments illustrated.

Referring to FIG. 1, the grip and backweighting assembly of the invention are generally designated as reference numeral 10. The golf shaft 1 has installed on its distal end a golf grip 3 which has molded therein an internally threaded hexagonal nylon nut 5 into which is threaded a one piece insert 7 of nylon material comprising a long externally threaded thin rod 9 which abuts a greater diameter section 11. The section 11 continues as a section 13 which changes to a wider section 15 around which is attached an end cap 17 made of the same material as the grip 3. Section 13 rests on the proximal end of the shaft 1. Section 15 has an external threads 23 for engaging the nut 5 and attachment of the insert 7 to the grip 3.

Still referring to FIG. 1, the internally threaded weight sections 14 are screwed onto the externally threaded rod 9, each weight separated from adjacent weights by a noise dampening shock absorber or damper 19 made of soft neoprene rubber or other similar material and held in place by a nylon securing nut 21. Any number of weights 13 with absorbers 19 may be installed along the threaded rod 9 to achieve the desired backweighting.

Figure 2:
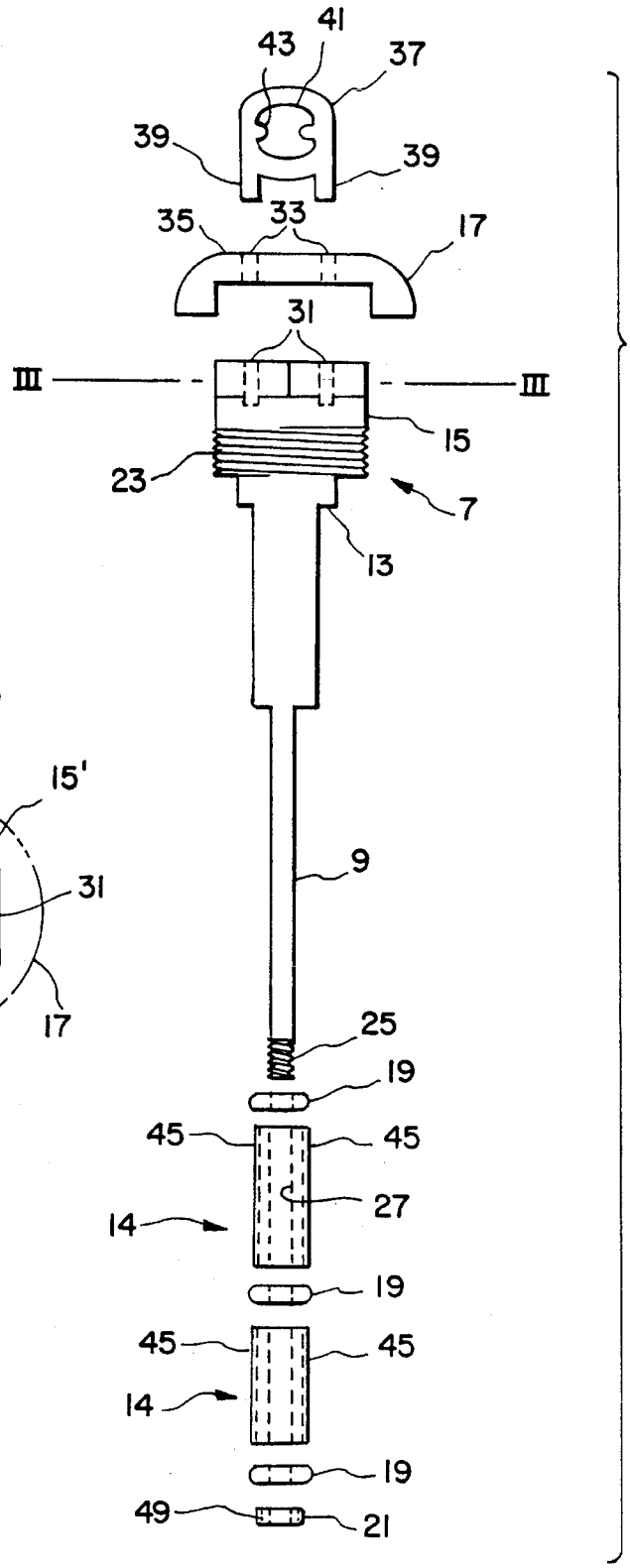
FIG. 2 is a side view of the adjustable backweighting assembly and end cap rotating tool shown exploded for greater detail.

FIG. 2 illustrates a side view of the backweighting assembly without the grip for clarity purposes. In FIG. 2, the removable embodiments of the invention comprises a multi-sectioned one-piece insert 7 including the long rod 9 which becomes an externally threaded section of a greater diameter 15 which screws into the nut-like section 5 of the universal grip assembly and continues to become an end section. Preferably section 15 concludes with an end section of hexagonal shape 15' to provide a method to prevent internal spinning when installed with the end cap 17 around the hexagonal section 15'. Dampers 19 are a doughnut shaped neoprene rubber or other similar soft flexible material which are not threaded internally to allow for free movement along the rod 9. The securing nut 21 or any other suitable fastener can be used to install and tighten the weights.

The universal grip assembly secured by threads within the grip 3 provides the crux of the instant invention with the capability of quickly adding or removing weights 14 on a club-by-club basis.

Still with reference to FIG. 2, it should be understood that the external threads 23 on the section 15 can be located elsewhere on the insert 7 to facilitate attachment to the athletic implement grip 3. In fact, any means for attaching can be utilized to secure the insert to the grip such as pins extending through both the grip and insert, permanent installation such as a glue or adhesive, a snap or force fit coupling or the like. Further, the grip 3 could have a spiral channel inside with an insert having nubs that fit into the channel. The insert could then be secured by a full revolution twist-in. The grip could also have a narrow slot around the inside thereof with the insert having pins or an expanding collar that is cam driven to expand when in position. A special insert key could be provided to turn the cam to expand the pins or collar for attachment to the grip. Another attachment alternative includes the grip having a groove around its inside with an insert which is enlargable when in place. Enlargement of the insert could be by removal of a pin or control rod similar to a pop-rivet wherein a pin is pulled and the rivet expands.

The section 11 is added for structural integrity between the section 13 and the rod 9. However, the rod 9 could extend directly from the section 13 or 15 if so desired.

FIG. 2 shows another aspect of the invention wherein the distal end of the rod 9 is threaded at reference numeral 25. In this embodiment, the internal bore 27 of the weights 14 would be smooth surfaced to slide over the rod 9, the weights and dampeners 19 secured by engagement of the nut 21 with the threaded portion 25. Of course, any type of fastener can be used in place of the nut 21 for securing the weights and dampers to the insert 7.

FIG. 2 also illustrates the means for rotating the insert into a given grip. First, the section 15 has recesses 31 therein. The end cap 17 also has bores 33 through the end 35 thereof. The bores 33 are spaced to align with the recesses 31 in the insert 7.

A rotating tool 37 is provided having prongs 39 which are spaced apart to slide through the bores 33 into the recesses 31 of the insert 7. Insertion of the prongs 39 into the recesses 31 permit clockwise and counterclockwise rotation of the insert for attachment or removal to a given athletic implement handle.

The rotating tool also can have an opening 41 with diametrically opposed protrusions 43 therein. The protrusions 43 are designed to engage opposing recesses 45 in the weights 14 to facilitate attachment of the weights 14 when an externally threaded rod 9 is used. The prongs of the rotating tool 37 can be sized to double as a golf spike attachment tool.

A typical weight section 13 can be a length of lead, lead alloy, or brass, or other metal of a fixed weight based on specific length and is either threaded to mate with the threaded rod 9 or has a smooth bore for sliding attachment, see FIG. 2. As described above, the recesses 45 can extend half-way along the length of two sides of the weight to facilitate installation and removal. A similar recess or slot arrangement 49 can also be located on the securing nut 21 to provide a secure retainer after the last dampener 19 is installed along rod section 9.

Figure 3:
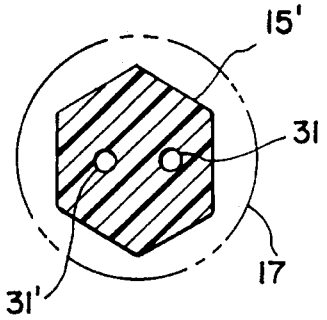
FIG. 3 is a cross-sectional view along the line III—III of FIG. 2.

With reference to FIGS. 2 and 3, the optional hexagonal end 15' of the section 15 is shown in cross section mating with the end cap 17 shown in phantom. Again, the hexagonal fit of the end cap section 15' reduces or eliminates loosening of the insert during club use. However the section 15 can terminate as a cylinder at the grip through opening or in connection with an appropriately sized end cap.

It should be understood that the novel grip and backweighting assembly can be made of any conventional materials. In addition, the internal surface of the grip can be directly threaded to receive the externally threaded section 15 for attachment of the insert to the athletic implement grip 3.

As such, an invention has been disclosed in terms of preferred embodiments thereof which fulfill each and every one of the objects of the present invention as set forth hereinabove and provides a new and improved grip with adjustable backweighting capability for athletic implements.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. An adjustable backweighting assembly for an athletic implement having a hollow shaft with a clubhead at one end and a gripping portion at the opposite end, the adjustable backweight assembly further comprising:

a) a plurality of weights mounted on an insert;

b) a grip sized to surround said gripping portion, said grip having a through opening in an end thereof;

c) means for removably attaching said insert mounted weights to said grip such that said weights and a portion of said insert extend within said hollow shaft gripping portion for adjusting backweighting of said athletic implement, wherein said means for removably attaching further comprises:

i) said grip having a proximal end extending beyond the opposite end of said hollow shaft and including said through opening, said proximal end having an internally threaded portion; and ii) an externally threaded portion on a proximal end of said insert sized to engage said internally threaded portion of said grip.

2. The assembly of claim 1 wherein said internally threaded portion comprises a nut mounted in said through opening.

3. The assembly of claim 1 wherein said insert has a threaded shaft and each said weight is threaded thereon.

4. The assembly of claim 1 wherein adjacent weights are separated by a damper mounted on said insert.

5. The assembly of claim 1 wherein said insert includes means for rotating said insert on a proximal end thereof.

6. The assembly of claim 5 wherein said means for rotating further comprises a pair of recesses in said insert proximal end, each said recess sized to receive a rotating tool for insert rotation.

7. The assembly of claim 6 further comprising a grip end cap sized to surround a proximal end of said insert extending through said through opening of said grip.

8. The assembly of claim 7 wherein said grip end cap has a pair of bores therethrough, each bore aligned with a respective said recess to facilitate rotation of said insert.

9. The assembly of claim 5 further comprising a rotating tool having prongs sized to fit said recesses.

10. The assembly of claim 9 wherein each said weight is cylindrical in shape and has at least a pair of slots along an outer surface thereof to facilitate weight rotation.

11. The assembly of 10 wherein said rotating tool is annular in shape and said prongs extend from an outer periphery thereof, said rotating tool having opposite facing protrusions on an inner periphery thereof, each said protrusion sized to engage said slot of said weight.

12. The assembly of claim 1 further comprising a grip end cap sized to surround a proximal end of said insert extending through said through opening of said grip.

13. The assembly of claim 1 wherein said insert is threaded on at least a distal end to receive a nut to secure said weights to said insert.

14. The assembly of claim 1 wherein said athletic implement is a golf club.

15. The assembly of claim 1 wherein said insert has a shaft portion for receiving said weights and an enlarged portion for engagement with said grip.

16. The assembly of claim 1 wherein each said weight is cylindrical in shape and has at least a pair of slots along an outer surface thereof to facilitate weight rotation.

17. An athletic implement backweighting assembly for use with a hollow shafted athletic implement comprising:

a) a grip having a hollow interior terminating in a through opening in a proximal end of said grip, said through opening including an internally threaded portion therein; and b) a backweighting assembly for attachment to said grip and insertion in a portion of said hollow shaft, said backweighting assembly further comprising:

i) an insert having an externally threaded portion sized to engage said internally threaded portion of said grip and a pair of recesses in a proximal end thereof;

ii) a shaft extending from said first externally threaded portion;

iii) a plurality of weights attachable to said shaft;

iv) at least one damper washer sized to fit on said shaft and between adjacent ones of said weights;

v) a fastener sized to secure said weights and said at least one damper washer to said shaft;

vi) a grip end cap sized to surround said proximal end of said insert, said end cap having bores therethrough which are aligned with respective said recesses to facilitate rotation of said insert; and vii) wherein said externally threaded portion of said insert is attached to said internally threaded portion of said grip such that said shaft extends within the hollow shaft of an athletic implement handle surrounded by said grip.

* * * * *